US006932746B2

(12) United States Patent
Wong

(10) Patent No.: US 6,932,746 B2
(45) Date of Patent: Aug. 23, 2005

(54) JUMPING STICK

(76) Inventor: Jon G. Wong, 357 Ximeno Ave., Long Beach, CA (US) 90803

( * ) Notice: Subject to any disclaimer, the term of this patent is extended or adjusted under 35 U.S.C. 154(b) by 0 days.

(21) Appl. No.: 10/298,436

(22) Filed: Nov. 18, 2002

(65) Prior Publication Data

US 2003/0096678 A1 May 22, 2003

Related U.S. Application Data

(60) Provisional application No. 60/331,983, filed on Nov. 20, 2001.

(51) Int. Cl.[7] ..... A63B 25/08
(52) U.S. Cl. ..... 482/77
(58) Field of Search ..... 482/75–77, 23; D21/415, 413, 78, 122–124, 112

(56) References Cited

U.S. PATENT DOCUMENTS 2,783,997 A * 3/1957 Gaffney et al. ..... 482/77
3,731,920 A * 5/1973 Matsuda ..... 482/77
3,915,451 A * 10/1975 Adams et al. ..... 482/23
4,390,178 A * 6/1983 Rudell et al. ..... 482/77
4,632,371 A * 12/1986 Wirges et al. ..... 267/64.28
4,828,251 A * 5/1989 Schreiber ..... 482/77
6,168,555 B1 * 1/2001 Fetterleigh et al. ..... 482/77
6,558,265 B1 * 5/2003 Middleton ..... 472/135

* cited by examiner

*Primary Examiner*—Gregory L. Huson
*Assistant Examiner*—Fenn C. Mathew
(74) *Attorney, Agent, or Firm*—Raymond Sun

(57) ABSTRACT

A jumping stick has a handle bar and a cylindrical outer shaft. The outer shaft has a bore, an upper end coupled to the handle bar, and a lower end with an opening provided at the lower end that extends into the bore. The jumping stick further includes an inner shaft having an upper end that extends into the bore of the outer shaft, a spring element operatively coupled to the inner shaft, and a landing base coupled to the lower end of the inner shaft.

8 Claims, 2 Drawing Sheets

JUMPING STICK

RELATED CASES

This application claims priority from Provisional Application No. 60/331,983, filed Nov. 20, 2001, entitled "Gopo Stick—A jumping stick with a landing base", whose entire disclosure is incorporated by this reference as though set forth fully herein.

BACKGROUND OF THE INVENTION

1. Field of the Invention

The present invention relates to jumping sticks.

2. Description of the Prior Art

Jumping sticks have become very popular in recent times. However, conventional jumping sticks have a very narrow landing base, which makes it difficult for the rider to obtain optimal stability and balance.

SUMMARY OF THE DISCLOSURE

It is an object of the present invention to provide a jumping stick that is easy to ride.

It is another object of the present invention to provide a jumping stick that provides excellent balance to the user.

It is yet another object of the present invention to provide a jumping stick that provides improved stability.

In order to accomplish the objects of the present invention, there is provided a jumping stick having a handle bar and a cylindrical outer shaft. The outer shaft has a bore, an upper end coupled to the handle bar, and a lower end with an opening provided at the lower end that extends into the bore. The jumping stick further includes an inner shaft having an upper end that extends into the bore of the outer shaft, a spring element operatively coupled to the inner shaft, and a landing base coupled to the lower end of the inner shaft.

DETAILED DESCRIPTION OF THE PREFERRED EMBODIMENTS

Figure 1:
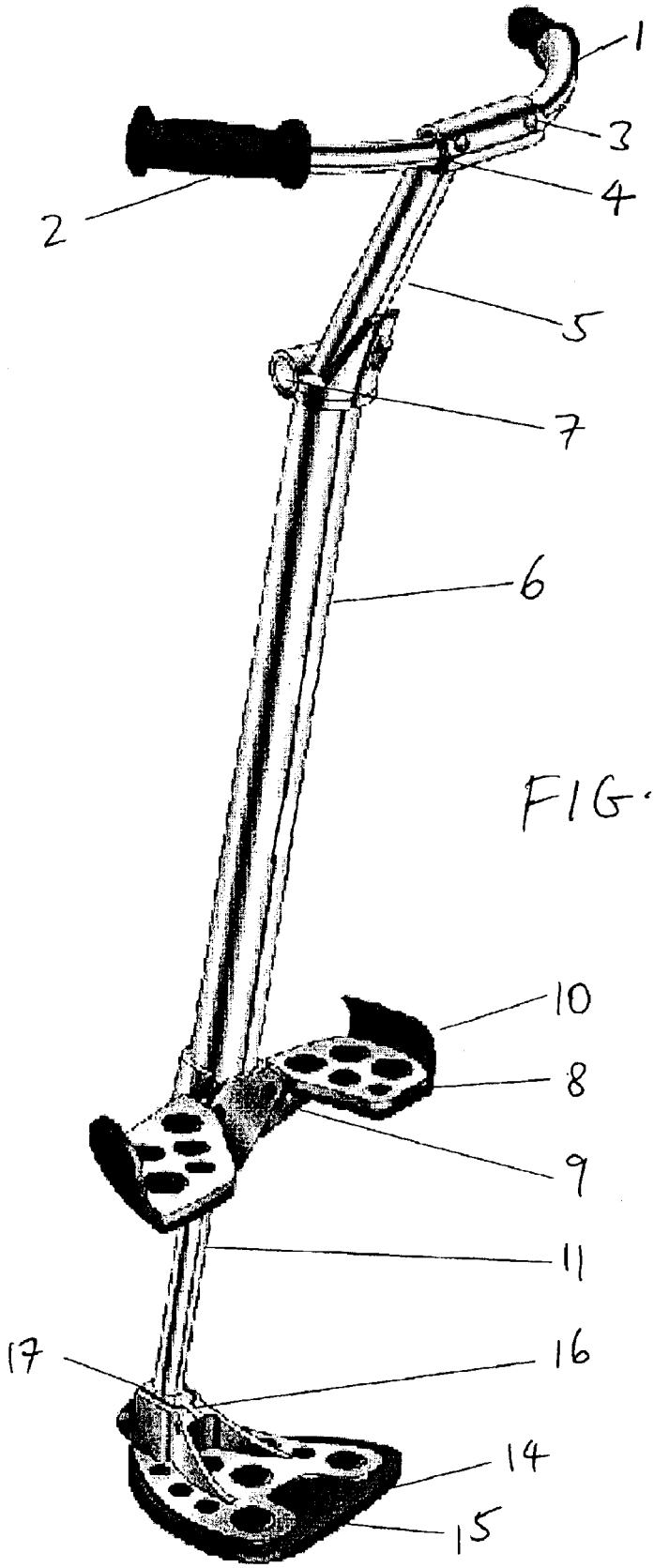
FIG. 1 is a perspective view of a jumping stick according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a new and improved jumping stick that is easier to ride and balance than the currently-available jumping sticks. The jumping stick of the present invention differs from the conventional jumping sticks in that the present invention provides parts that join at offset angles to one another, and has a larger landing base. The offset arrangement of these parts positions the rider's center of gravity more directly on top of the jumping stick in contrast to the rearward position of the rider's center of gravity on the conventional jumping sticks. The offset arrangement of the parts also allows the rider to negotiate a chosen direction of travel. The enlarged landing base also assists in directing the direction of travel as well as providing for greater stability. The stability of the base may allow the jumping stick to be self-standing during non-use and allows the rider to mount the jumping stick without the coordination of jumping and balancing as required by conventional jumping sticks. The base also allows the rider to remain perched, in a stationary position, upon the jumping stick without the cause and effect relationship of jumping and balancing.

To initiate the play pattern, the rider mounts the jumping stick and compresses the height of the jumping stick. The compression is followed by a projection as the spring element of the jumping stick exerts its normal bias to maintain the original height of the jumping stick. This jumping movement continues for as long as the rider continues to compress the height of the jumping stick.

The jumping stick of the present invention is an assembly made up of four subassemblies: the handle bar subassembly, the outer body subassembly, the inner body subassembly, and the landing base subassembly.

The handle bar has a handle bar 1, a pair of hand grips 2 provided on opposing ends of the handle bar 1, a handle bar folding mechanism 3 that is positioned at about the center of the handle bar 1, a handle bar bushing 4, and a pivoting handle bar stem 5 that extends from the handle bar folding mechanism 3.

The outer body subassembly has a cylindrical outer shaft 6, a stem folding mechanism 7 that is operatively coupled to both the handle bar stem 5 and the upper end of the outer shaft 6, a foot platform 8 positioned at the lower end of the outer shaft 6, and a foot platform folding mechanism 9 that couples the lower end of the outer shaft 6 and the foot platform 8. A side wall 10 can be provided at the outer edge of each foot platform 8.

The inner body subassembly has an inner shaft 11 that is received inside the outer shaft 6 along the upper portions of the inner shaft 11. The inner body subassembly also has a spring element 12 that is wrapped or coiled around the upper portion of the inner shaft 11 and positioned inside the outer shaft 6.

The landing base subassembly has a bottom plate 14, a top plate 15 attached to the top of the bottom plate 14, a landing base folding mechanism 16 that operatively couples the top plate 15 and the bottom end of the inner shaft 11, and a landing base bushing 17 associated with the landing base folding mechanism 16.

The handle bar 1 is preferably made of a rigid material such as plastic or metal. The handle bar 1 may be comprised of a single part or two parts joined at or near the center. One end of each handle bar part is capped with a hand grip 2. The hand grips 2 take into consideration the ergonomics of the hand and are preferably made of slightly compressible material. The handle bar folding mechanism 3 is preferably made of a rigid material such as plastic or metal. The handle bar 1 may contain a bushing 4, which is preferably made of a shock/vibration absorbing material and which is placed between the outer surface of the handle bar 1 and the interior surface of the handle bar folding mechanism 3. The handle bar stem 5 is elongated and can function to adjust the height of the handle bar 1 (e.g., by providing a telescoping stem 5). The handle bar stem 5 may also be rotated 360 degrees or be locked in a fixed position. The handle bar stem 5 is preferably made of a rigid material such as plastic or metal.

The outer shaft 6 of the outer body subassembly is elongated and is preferably made of a rigid material such as plastic or metal. The stem folding mechanism 7 and foot platform folding mechanism 9 can be molded from plastic or metal. The foot platform 8 is preferably made of a rigid material such as plastic or metal, while the foot platform sidewall 10 is preferably made of a slightly flexible material.

The inner shaft 11 is preferably made of a rigid material such as plastic or metal. The inner shaft 11 provides an internal arrangement of parts and energy along a vertical line. The spring element 12 may be a coiled metal part, or can be provided in the form of an air or hydraulic cylinder. A spring action chamber provided is the hollow portion of the inner body structure that allows for the up and down movement of the spring element 12.

The landing base offers stability and may be detachable from the inner shaft 11. The landing base may be made of one or more parts. For example, the landing base can be made of two parts, a top plate 15 that is preferably made of a rigid material such as plastic and/or metal, and a bottom plate 14 that is is preferably made of a durable, non-skid material that may, by nature of the material and/or the shape of the bottom plate 14, have the ability to absorb shock. The landing base is provided in a size and shape that allows the landing base to support the entire jumping stick in an upright position. The landing base folding mechanism 16 functions to compact or remove the landing base, and can be molded from plastic or metal. The landing base folding mechanism bushing 17 is preferably made of a shock/vibration absorbing material and is placed between the outer surface of the bottom end of the inner shaft 11, and the interior surface of the landing base folding mechanism 16.

Figure 3:
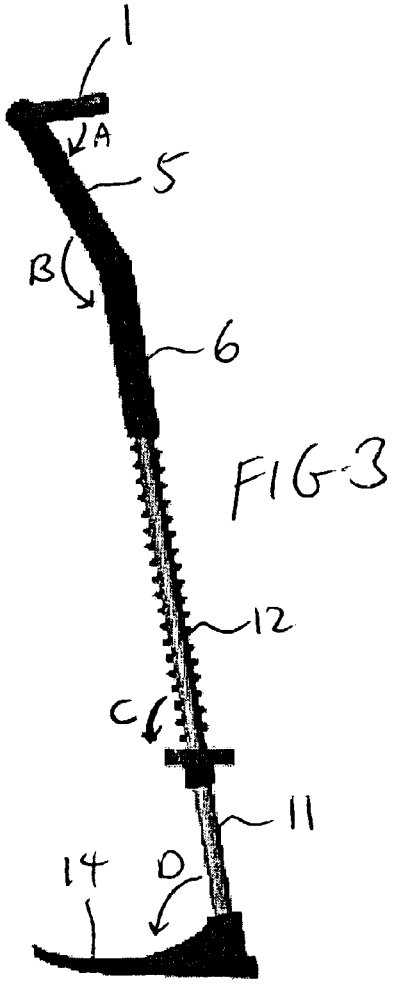
FIG. 3 is a sectional side plan view of the jumping stick of FIG. 1 showing the inner shaft and the spring element.
Figure 2:
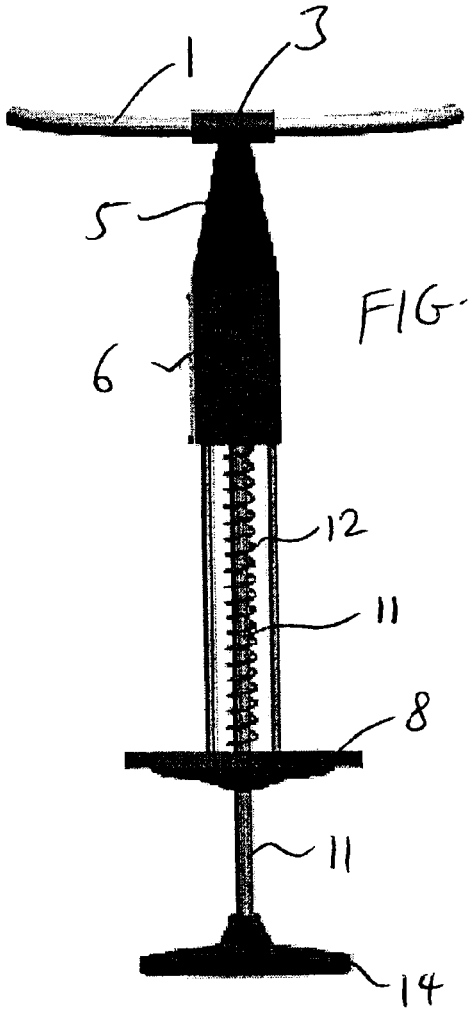
FIG. 2 is a sectional front plan view of the jumping stick of FIG. 1 showing the inner shaft and the spring element.

The ends of the handle bar 1 are configured to accommodate the positioning of the rider and are therefore preferably curved or angled towards the rider from the centerpoint of the handle bar 1. However, the handle bar 1 can also be straight, bent or curved. The handle bar 1 may be a stationary unit or can be two parts joined together by the handle bar folding mechanism 3 that is located at the centerpoint of the handle bar 1. The handle bar bushing 4 can assist in this connection of the two separate parts. The handle bar 1 is connected to the outer body subassembly via the handle bar stem 5 and stem folding mechanism 7 which is attached to the top of the outer shaft 6. The handle bar stem 5 can be connected to the handle bar 1 and the outer shaft 6 at offset angles A and B that can be greater-than or less-than ninety degrees from either connection, as best shown in FIGS. 1 and 3.

The foot platform 8 is connected to the bottom of the outer shaft 6. The foot platform sidewalls 10 can be optional. This connection between the foot platform 8 and the outer shaft 6 can be stationary (i.e., fixed) or can be via the foot platform folding mechanism 9. The foot platform 8 can be connected to the outer shaft 6 at an offset angle C of greater-than or less-than ninety degrees (see FIG. 3). The point of attachment between the horizontal surface of the foot platform 8 may be offset as well and/or asymmetrical with respect to the outer shaft 6 in design to position the rider's center of gravity more directly over the landing base 14.

The lower portion of the inner shaft 11 extends out of the open end of the outer shaft 6 below the foot platform 8.

The bottom of the inner shaft 11 is connected to the landing base top plate 15 at the landing base folding mechanism 16 or at a stationary receptacle (not shown). The landing base folding mechanism 16 can be offset at an angle D with respect to the horizontal surface of the landing base top plate 15 (see FIG. 3). The landing base bushing 17 assists in the connection of the inner shaft 11 and the landing base folding mechanism 16. The inner shaft 11 can be connected to the landing base top plate 15 at an offset angle D of greater-than or less-than ninety degrees (see FIG. 3). The connection of the inner shaft 11 and landing base may be enhanced by a self-centering feature. The landing base top plate 15 has a diameter greater than the diameter of the spring element 12 or the outer shaft 6, so as to enhance the stability. The entire landing base subassembly may be detachable from the inner shaft 11.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A jumping stick, comprising:

a handle bar;

a cylindrical outer shaft having a bore, an upper end coupled to the handle bar, and a lower end with an opening provided at the lower end that extends into the bore;

an inner shaft having an upper end that extends into the bore of the outer shaft, and a lower end;

a foot platform coupled to the outer shaft;

a spring element operatively coupled to the inner shaft; and a landing base removably coupled to the lower end of the inner shaft, the landing base provided in the form of at least one plate that has a surface area that is at least three times larger than the cross-sectional area of the inner shaft wherein the landing base is attached non-pivotally at an acute angle with respect to the inner shaft.

2. The jumping stick of claim 1, wherein the landing base has a size and shape which allows the landing base to support the entire jumping stick in an upright position.

3. The jumping stick of claim 1, further including a handle bar stem that couples the handle bar to the upper end of the outer shaft, wherein the handle bar stem is disposed at an angle with respect to the outer shaft.

4. The jumping stick of claim 1, wherein the landing base is disposed at an angle with respect to the inner shaft.

5. The jumping stick of claim 1, wherein the landing base has an upper plate and a lower plate that is made from a different material as the upper plate.

6. A jumping stick, comprising:

a handle bar;

a cylindrical outer shaft having a bore, an upper end coupled to the handle bar, and a lower end with an opening provided at the lower end that extends into the bore;

an inner shaft having an upper end that extends into the bore of the outer shaft, and a lower end;

a foot platform coupled to the outer shaft;

a spring element operatively coupled to the inner shaft; and a landing base coupled to the lower end of the inner shaft, wherein the landing base is non-pivotally attached at an acute angle with respect to the inner shaft.

7. The jumping stick of claim 6, further including a handle bar stem that couples the handle bar to the upper end of the outer shaft, wherein the handle bar stem is disposed at an angle with respect to the outer shaft.

8. The jumping stick of claim 6, wherein the landing base includes at least one plate.

* * * * *